US009242149B2

(12) United States Patent
Carter

(10) Patent No.: US 9,242,149 B2
(45) Date of Patent: Jan. 26, 2016

(54) MEDICINE BALL SYSTEM

(71) Applicant: Abdul Sean Carter, Brooklyn, NY (US)

(72) Inventor: Abdul Sean Carter, Brooklyn, NY (US)

( * ) Notice: Subject to any disclaimer, the term of this patent is extended or adjusted under 35 U.S.C. 154(b) by 113 days.

(21) Appl. No.: 13/962,664

(22) Filed: Aug. 8, 2013

(65) Prior Publication Data

US 2015/0045191 A1 Feb. 12, 2015

(51) Int. Cl.

*A63B 21/00* (2006.01)
*A63B 41/00* (2006.01)
*A63B 41/04* (2006.01)

(52) U.S. Cl.

CPC ..... *A63B 41/04* (2013.01); *A63B 41/00* (2013.01)

(58) Field of Classification Search

CPC ..... A63B 2/10
USPC ..... 473/577, 594, 595, 596, 597, 598, 599; 482/132, 148, 49, 92, 93, 106
See application file for complete search history.

(56) References Cited

U.S. PATENT DOCUMENTS

| | | | | | |
|---|---|---|---|---|---|
| 1,692,305 | A | * | 11/1928 | Jacobus | 473/603 |
| 1,900,544 | A | * | 3/1933 | Craig | 473/608 |
| 4,333,648 | A | * | 6/1982 | Aoyama | 473/604 |
| 5,035,426 | A | * | 7/1991 | Spector | 473/599 |
| 5,286,020 | A | | 2/1994 | Caruso | |
| 5,433,438 | A | * | 7/1995 | Gilman | 482/93 |
| 5,577,732 | A | * | 11/1996 | Spector | 473/576 |
| 5,730,287 | A | * | 3/1998 | Martin | 206/315.9 |
| 5,772,543 | A | * | 6/1998 | Paino | 473/594 |
| 6,398,677 | B1 | * | 6/2002 | Hergert et al. | 473/599 |
| 7,485,058 | B1 | * | 2/2009 | Payne et al. | 473/607 |
| 8,272,980 | B1 | * | 9/2012 | Johnson | 473/603 |

* cited by examiner

*Primary Examiner* — Jerome W Donnelly
(74) *Attorney, Agent, or Firm* — Dwayne L. Bentley; DL Bentley Law Group PLLC

(57) ABSTRACT

A medicine ball system is disclosed. The system includes a medicine ball and a closure cover configured to receive the medicine ball, where the closure cover includes weighted material that enables a person to simply increase the weight of the medicine ball without having to change to another medicine ball.

6 Claims, 2 Drawing Sheets

100

200

MEDICINE BALL SYSTEM

FIELD OF THE INVENTION

The present invention relates to a medicine ball system where a user of a medicine ball is able to adjust the amount of weights utilized with the medicine ball.

BACKGROUND OF THE INVENTION

Generally, medicine balls were used in gym facilities in order to provide aerobic exercise to a person when the ball is thrown or caught. Typically, medicine balls are relatively heavy and have considerable mass in order to produce optimum expenditure of energy when the ball is in use. The mass is generally provided by surrounding a heavy object with a fibrous material such as loose cotton batting or wadded pieces of cloth. The outside of the ball is generally composed of sections of leather, cloth, rubber or plastic stitched together to form a spherical covering around the heavy, padded central mass. The outside of the ball is soft and pliable so that it can be grasped more easily when being thrown or caught.

The problem with this type of medicine ball is that it would often be necessary to have many different medicine balls in a gym or home to accommodate different expenditures of energy. For example, there may be a need for a 2 pound medicine ball, 4 pound medicine ball or 6 pound medicine ball to expend various amounts of energy in a gym or home, which adds clutter to the gym or home.

There is a need for a medicine ball system that allows a person to use only one medicine ball in a limited amount of space in a gym or a home instead of a number of medicine balls so that the medicine balls don't add clutter to the gym or home.

SUMMARY OF THE INVENTION

The present invention has been accomplished in view of the above-mentioned technical background, and it is an object of the present invention to provide a medicine ball.

In a preferred embodiment of the invention, A medicine ball system is disclosed. The system includes a medicine ball and a closure cover configured to receive the medicine ball. The closure cover device includes weighted material that increases the weight of the medicine ball.

In another preferred embodiment of the invention, a method for making a medicine ball system. The method includes: providing a medicine ball; and inserting the medicine ball into a closure cover, where the closure cover includes weighted material that increases a weight of the medicine ball.

In yet another preferred embodiment of the invention, a ball system is disclosed. The ball system includes a ball and a closure cover configured to receive the ball, wherein the weighted closure cover includes weighted material that increases the weight of the ball.

BRIEF DESCRIPTION OF THE DRAWINGS

These and other advantages of the present invention will become more apparent as the following description is read in conjunction with the accompanying drawings, wherein.

DETAILED DESCRIPTION OF THE INVENTION

The presently preferred embodiments of the invention are described with reference to the drawings, where like components are identified with the same numerals. The descriptions of the preferred embodiments are exemplary and are not intended to limit the scope of the invention.

Figure 1:
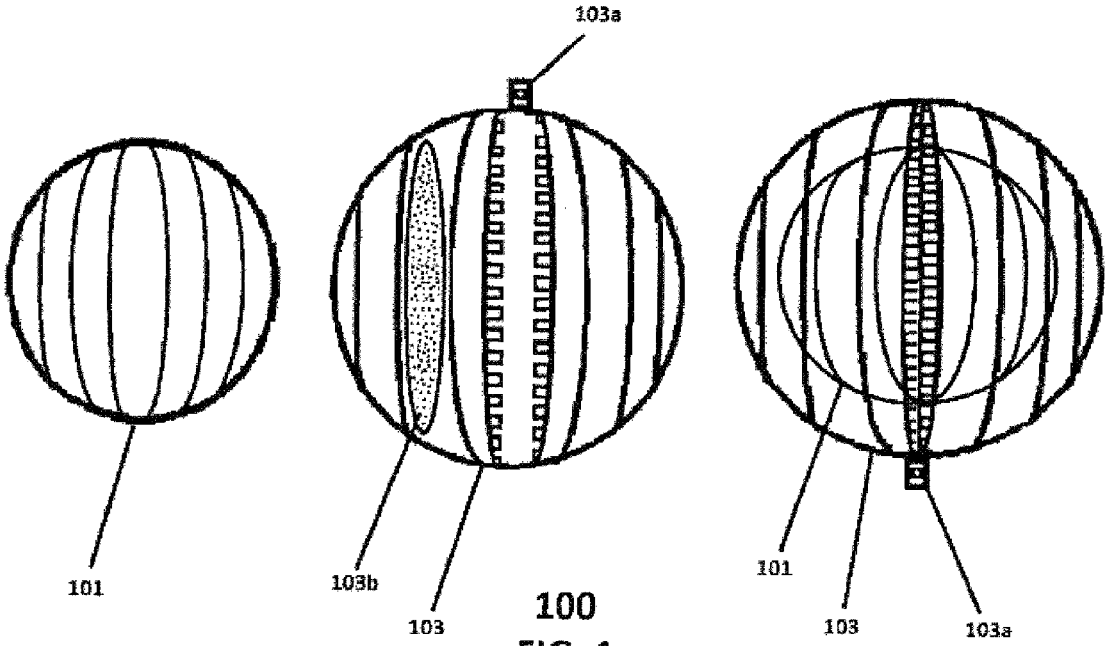
FIG. 1 is an illustration of a medicine ball system in accordance with the invention.

FIG. 1 is a description of a medicine ball with a closure cover. A typical medicine ball 101 is shown with a closure cover 103 that forms a medicine ball system 100. Medicine ball 101 may have a standard weight of 5-20 pounds or 1-30 kilograms and have a standard 10-15 inches diameter or a larger diameter. In another embodiment of the invention, medicine ball 101 may be a kettlebell that may have a weight of 12 kilograms, 16 kilograms or 24 kilograms. Closure cover 103 has a spherical shape and is composed of a leather, rubber or plastic type material. The closure cover 103 may weigh 1-10 pounds or 1-22 kilograms with a diameter in the range of 25-35 inches diameter or a larger diameter. Inside an internal portion 103*b* of the closure cover 103 there may be weighted material such as liquid gels or sand that's evenly distributed throughout the entire closure cover 103, which adds extra weight to the medicine ball 101 when the medicine ball 101 is placed inside the closure cover 103 to form the medicine ball system 100. In another embodiment of the invention, inside the closure cover 103 instead of the liquid gels or sand there may be typical bb pellets that has a weight in the range of 1-10 pounds or kilograms, which are also used to add extra weight to the medicine ball system 100. Closure cover 103 is utilized with a typical medicine ball 101 in order to reduce the space that would be utilized for several medicine balls at a gym or a home. Typically, several medicine balls varying in weight will take up much needed space at a gym or home. The closure cover 103 allows a person to easily and simply increase the weight of one medicine ball without the person utilizing several medicine balls that take up precious space thereby reducing the space several medicine balls will take in a gym or home.

The utilization of the liquid gels, sand or bb pellets inside the internal portion 103*b* of the closure cover 103 increases the weight of a 5 pound medicine ball to a 7 pound Medicine ball based on the 2 pound closure cover 103 or a 9 pound Medicine ball based on the 4 pound closure cover 103 where the 5 pound medicine ball will be placed inside the closure cover 103.

The closure cover 103 has a larger size than a typical medicine ball 101 in order to encapsulate the medicine ball 101 or retain the medicine ball 101 inside the closure cover 103. The closure cover 103 includes a typical zipper 103A to hold and retain the medicine ball 101 inside of the weighted closure cover 103 to form the medicine ball system 100. In another embodiment, the zipper 103*a* may be any type of closure mechanism such as a string enclosure or Velcro enclosure to retain the medicine ball 101 in the weighted closure cover 103.

Figure 2:
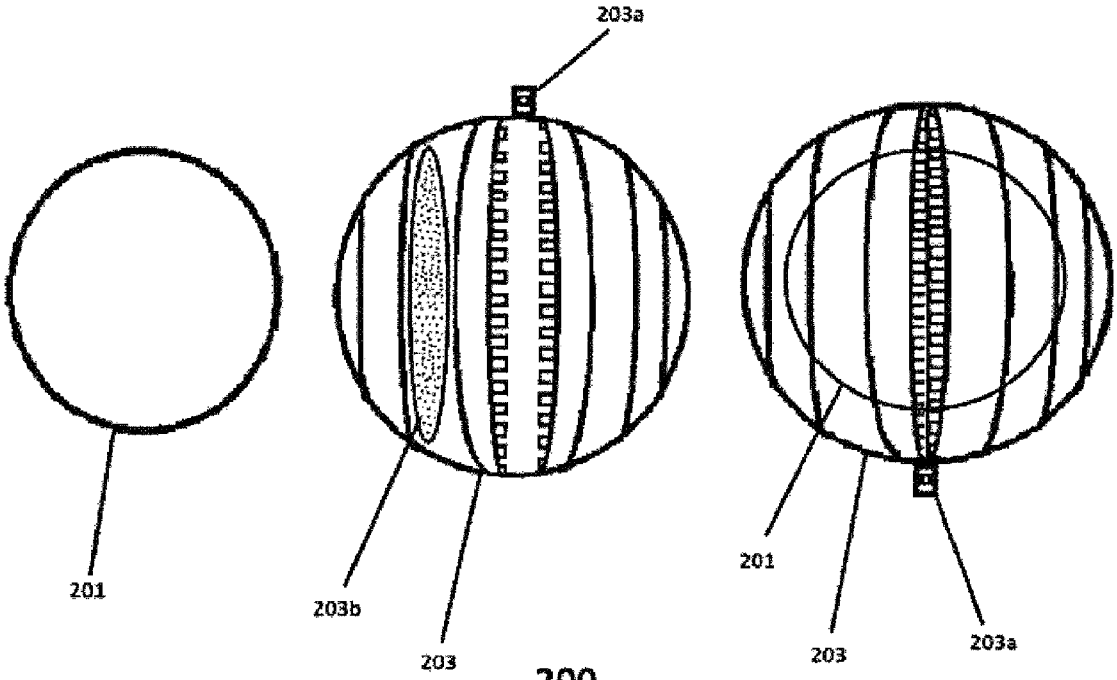
FIG. 2 is an illustration of a ball system in accordance with the invention.

FIG. 2 is a description of a ball with a closure cover. A typical ball 201 is shown with a closure cover 203 that forms a ball system 200. Ball 201 may be any type of an inflatable ball such as a basketball, beach ball, dodge ball, soccer ball or any type of inflatable ball. In another embodiment of the invention, the ball 201 may not be inflatable but a fixed size such as a baseball, softball, whiffle ball or football. This ball 201 may have the weight of a typical beach ball of 1-16 ounces or a soccer ball having a weight of 1-3 pounds. Closure cover 203 is equivalent to the closure cover 103 described above so a description will not be provided here. Inside an internal portion 203*b* of the closure cover 203 there may be weighted material such as liquid gels or sand that's evenly distributed throughout the entire closure cover 203, which adds extra weight to the ball 201 when the ball 201 is placed in the closure cover 203 to form the ball system 200. In another embodiment of the invention, inside the closure cover 203 instead of the liquid gels or sand there may be typical bb pellets that has a weight in the range of 1-10 pounds or kilograms, which are also used to add extra weight to the ball system 200. Closure cover 203 is utilized with a ball 201 in order to reduce the space that would be utilized for several balls at a gym or a home. Typically, several balls varying in weight will take up much needed space at a gym or home. The closure cover 203 allows a person to easily and simply increase the weight of one ball without the person utilizing several balls that take up precious space thereby reducing the space several balls will take in a gym or home.

The utilization of the liquid gels, sand or bb pellets inside the internal portion 203*b* of the closure cover 203 increases the weight of a ball by adding the extra weight of the closure cover 203 by 1-10 pounds depending on the weight of the closure cover.

The closure cover 203 has a larger size than a typical ball 201 in order to encapsulate the ball 201 or retain the ball 201 inside the closure cover 203. The closure cover 203 includes a typical zipper 203A to hold and retain the ball 201 inside of the weighted closure cover 203 to form the ball system 200. In another embodiment, the zipper 203*a* may be any type of closure mechanism such as a string enclosure or Velcro enclosure to retain the medicine ball 201 in the weighted closure cover 203.

This invention provides an improved medicine ball, where a person utilizing the medicine ball or any type of ball is able to utilize a closure device to encapsulate a medicine ball or the ball. The closure device encapsulates the medicine ball or ball, where the closure device is utilized to safely increase the weight of the medicine ball or ball without the need for a person to change the medicine ball or ball to increase the weight of the medicine ball or ball that helps to prevent clutter from occurring in a gym or home.

Although the present invention has been described above in terms of specific embodiments, many modifications and variations of this invention can be made as will be obvious to those of ordinary skill in the art, without departing from its spirit and scope as set forth in the following claims.

What is claimed is:

1. A medicine ball system comprising:

a medicine ball; and a closure cover configured to receive the medicine ball, wherein the closure cover includes weighted material that increases the weight of the medicine ball, wherein the weighted material is liquid gel.

2. The medicine ball system of claim 1 wherein the weighted closure cover is closed by utilizing a zipper.

3. The medicine ball system of claim 1 wherein the weighted closure cover has plurality of linings.

4. The medicine ball system of claim 1 wherein the weighted closure has a double lining.

5. A method for making a medicine ball system, the method comprising:

providing a medicine ball; and inserting the medicine ball into a closure cover, wherein the closure cover includes weighted material that increases a weight of the medicine ball, wherein the weighted material is sand.

6. A ball system comprising:

a ball; and a closure cover configured to receive the ball, wherein the closure cover includes weighted material that increases the weight of the ball, wherein the weighted material is sand.

* * * * *